United States Patent [19]

Halberschmidt et al.

[11] Patent Number: 4,519,167

[45] Date of Patent: May 28, 1985

[54] PROCESS AND APPARATUS FOR THE AUTOMATIC CONTROL OF MOVEMENT OF AN EDGE GRINDING MACHINE

[75] Inventors: Friedrich Halberschmidt, Herzogenrath; Heinz-Josef Reinmold, Aachen; Alfred Schmitz, Aachen; Heinz Mund, Aachen, all of Fed. Rep. of Germany

[73] Assignee: Saint-Gobain Vitrage, France

[21] Appl. No.: 459,116

[22] Filed: Jan. 19, 1983

[30] Foreign Application Priority Data

Jan. 20, 1982 [DE] Fed. Rep. of Germany ..... 3201494

[51] Int. Cl.[3] ..... B24B 9/10

[52] U.S. Cl. ..... 51/165.77; 51/35; 51/100 R; 51/283 E; 144/144 R; 409/80; 409/92

[58] Field of Search ..... 51/34 C, 34 D, 34 E, 51/34 F, 34 G, 35, 91 R, 92 R, 100 R, 100 P, 101 R, 105 EC, 165.71, 165.77, 165.8, 165.89, 165.91, 165.92, 283 R, 283 E; 409/80, 92, 97, 104, 110, 111, 112, 166, 186; 83/74; 144/144 R

[56] References Cited

U.S. PATENT DOCUMENTS

| | | | |
|---|---|---|---|
| 3,062,996 | 11/1962 | Ertell et al. | 409/92 X |
| 3,100,954 | 8/1963 | Lella | 51/165.77 |
| 3,274,736 | 9/1966 | Brokaw | 51/101 R X |
| 3,553,903 | 1/1971 | Christie | 51/165.9 |
| 3,641,711 | 2/1972 | Halberschmidt et al. | 51/100 R |
| 4,171,657 | 10/1979 | Halberschmidt et al. | 83/886 |
| 4,228,617 | 10/1980 | Bando | 51/3 |

FOREIGN PATENT DOCUMENTS

| | | | |
|---|---|---|---|
| 1950819 | 6/1970 | Fed. Rep. of Germany . | |
| 1966260 | 5/1972 | Fed. Rep. of Germany . | |
| 2437010 | 2/1976 | Fed. Rep. of Germany | 51/100 R |
| 2646062 | 4/1978 | Fed. Rep. of Germany . | |
| 2856519 | 7/1979 | Fed. Rep. of Germany . | |
| 1387113 | 3/1975 | United Kingdom | 51/101 R |

*Primary Examiner*—Robert P. Olszewski

*Attorney, Agent, or Firm*—Pennie & Edmonds

[57] ABSTRACT

The invention is in a process, and the apparatus, for path control of a processing tool of a grinding machine for an all-around edge grinding of a glass pane. A cross sled supports the processing tool for movement in an X-Y coordinate system wherein the path of movement of the cross sled is controlled by a program. The path control, however, is critically controlled by the use of a scanning instrumentality including a scanning organ which scans the edge of the glass pane along a path of movement in front of the processing tool. The scanning organ is supported by an arm articulated about the axis of the processing tool. The scanning organ leads the processing tool by a set distance, equal to the length of the arm, and determines the values for the X- and the Y-coordinates. The values that are developed by the scanning organ are stored in a sliding register having an input from each of the two axes. A signal developed by the sliding register is used for the control of the X-Y adjusting motors provided for moving the cross sled.

26 Claims, 13 Drawing Figures

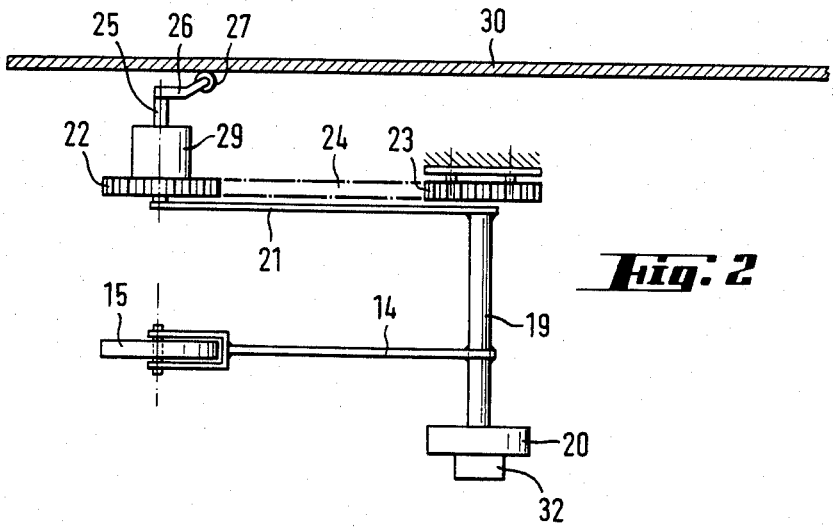
Fig. 2
Fig. 3
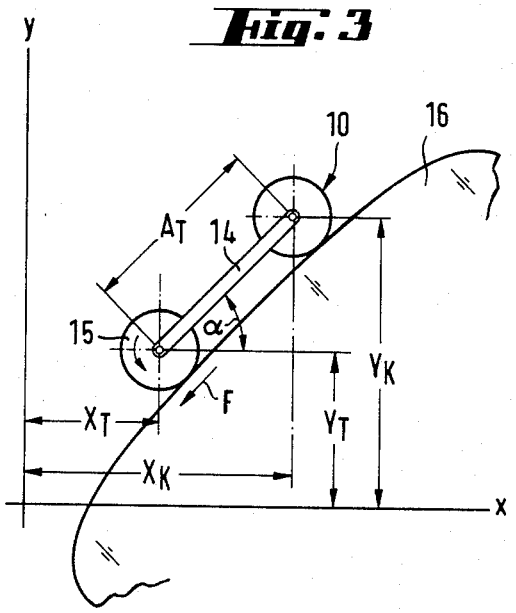

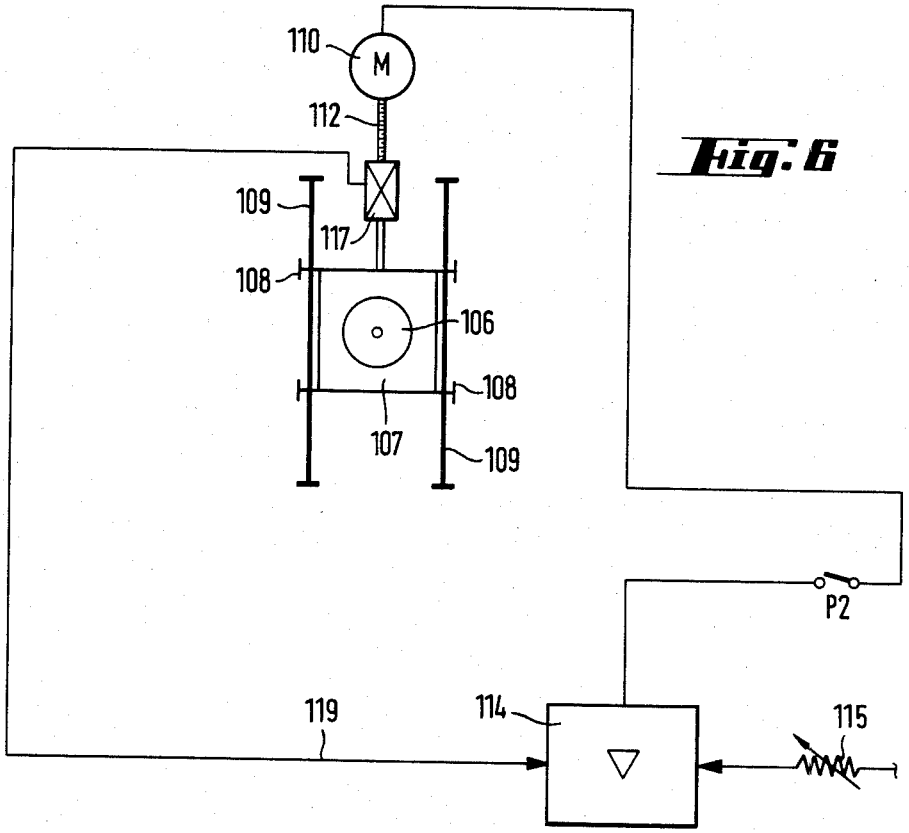
Fig. 6
Fig. 7
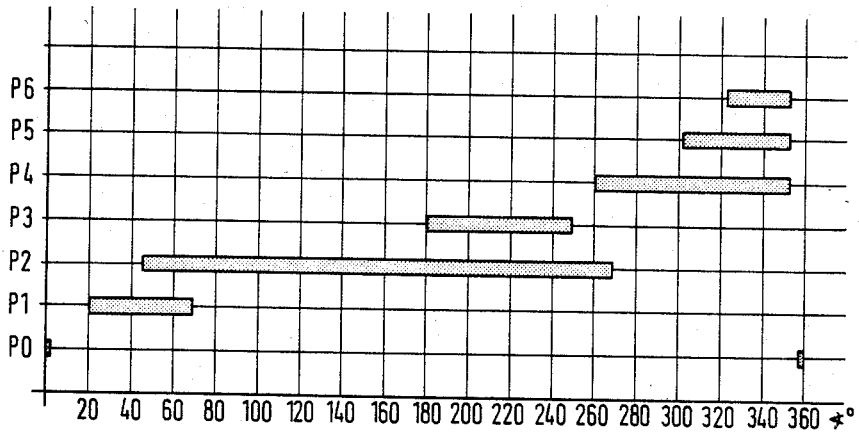

x
y
$M_x$
3
$X_S$
2
$X_T$
$X'_T$
20
4
10
155
160
M
11
$M_y$
5
158
14
15
α
$A_T$
16
1
$Y'_T$
$Y_T$
$Y_S$
2
159
156

180
182
R1
R2
R3
R4
R5
R6
R7
Z1
Z2
Z3
Z4
Z5
Z6
Z7
Z8
Z9
Z10
d13
d14
d15
±0V
+12
±0
-12
d5
P2
114
110
117
106
107
186
184
185
32
183
76
U
T
M

PROCESS AND APPARATUS FOR THE AUTOMATIC CONTROL OF MOVEMENT OF AN EDGE GRINDING MACHINE

DESCRIPTION

1. Technical Field

The invention relates to a process, and the apparatus, for the automatic, all-around path control in grinding the edge of a glass pane. The grinding head carrying the grinding tool is disposed on a sled movable in an X-Y coordinate system relative to the glass pane that rests firmly on a support.

2. Background of the Invention

A process and an apparatus for carrying out the process of edge grinding a glass pane is known to the prior art. For example, one representative prior art teaching is the teaching of German Offenlegungsschrift No. 28 56 519. This publication describes a grinding machine and a cross sled driven in an X-Y coordinate system by a pair of driving motors. Movement of the cross sled is controlled by a numerical control arrangement, and path information in movement of the cross sled is stored on a punch tape.

Another example of the prior art is the teaching of German Offenlegungsschrift No. 19 50 819. This publication describes a cross sled guided in movement in grinding the edge of a glass pane by a pattern or template which corresponds to the shape of the glass pane to be ground. Movement of the cross sled is controlled by a scanning arrangement that scans the pattern.

Both of the prior art teachings are considered to suffer from a major deficiency, namely that the apparatus is capable only of grinding the edge of a glass pane of some determined size and shape. Thus, a glass pane which is to be processed must be of the size and shape of the stored program (on the punch tape) or the pattern. Movement of the cross sled during the grinding operation is not subject to modification in the nature of the control.

The consequence of this type of operation should be clear. To this end, the operation is limited, and for every change in size and shape of a glass pane to be processed the program or the template which determines the path of movement of the cross sled in the X-Y coordinate system must be changed, also. These apparatus, moreover, suffer from the disadvantage of the requirement of a precise positioning of the glass pane, which oftentimes may result in considerable difficulty during the practice of the process.

SUMMARY OF THE INVENTION

In contrast to the apparatus of the prior art, the grinding apparatus of the invention is capable of providing path control in an all-around glass processing machine without the requirement of a predetermined path program, and without the requirement of a template to be followed. The invention, particularly, is suitable for the path control of a processing tool in the edge grinding of a glass pane of substantially any diverse shape, and the all-around path control may be provided without the requirement of precise positioning of the glass pane at a processing station. Thus, the application of the grinding apparatus is increased considerably, and adjusting times, in the adjustment from one program to another, are eliminated.

According to the invention, the grinding apparatus utilizes a scanning organ disposed on a cross sled which carries the processing tool. The scanning organ precedes the cross sled in conjoint movement in scanning the edge of the glass pane that is to be processed, thereby to determine the path control program of the processing tool for a definite stretch in front of the processing tool equal to the distance between the scanning organ and the processing tool. Signal values representing the position of the scanning organ in the X-Y coordinate system, as the scanning organ moves, are stored in a sliding register. As the signal values pass to the outputs, that is, the X- and Y-output terminals of the sliding register those signals are taken continuously and used to control a pair of servomotors after a time corresponding to the passage of the cross sled through the stretch. One servometer controls the movement of the sled in the X- direction, while the other servometer controls the drive of the sled in the Y- direction. The sliding register, therefore, always contains, temporarily, the control signals corresponding to the length of that stretch in the all-around path movement. Since no information is available from the sliding register for the first stretch of the path, an external control provides path control for movement of the processing tool in the X-direction. Thereafter, when the processing tool has moved throughout a distance equal to the length of the stretch, the sliding register will control further movement.

While the process and apparatus of the invention is used mainly for the path control of an all-around edge grinding machine, and the description will be set out in these terms, the apparatus may be used in the processing of glass panes either along their edge or along the surface adjacent the edge. In this latter respect, the glass pane may be provided with a continuous electric conducting strip along the edge or adjacent the surface or with a decorative strip along the surface adjacent the edge. It is also possible to use the process according to the invention, for example, for the control of the shape of the glass pane by comparing the values found by the control arrangement with stored theoretical values.

In a first form of the apparatus for carrying out the process, a processing tool is disposed on a cross sled capable of movement withn an X-Y coordinate system, and a scanning organ is mounted to the cross sled for movement in advance of the cross sled. The scanning organ comprises an arm capable of movement about a pivot axis and a scanning roller carried by the arm and pressed into contact with the edge of the glass pane. The scanning roller travels around the contour of the glass pane in the all-around movement and the direction of movement of the scanning roller is measured continuously. The signals representative of the coordinates of the scanning roller within the X-Y coordinate system are stored in a sliding register. These signals provide for control of the constant total speed and the speed ratio of an X- and Y- driving motor for driving the cross sled after the cross sled shall have been driven through a distance between the scanning roller and the tool which may be a grinding wheel.

A measurement of the direction of movement of the scanning roller at each increment of time is provided electrically by following movement of a rotation measuring instrument which describes the same path of movement as the axis of rotation of the scanning roller. The path of movement, also, is unchanged in its spatial angular position.

In one form of the invention, the rotation measuring instrument includes a sliding gear that rolls along a surface and adjusts an axis of rotation in directions opposite to the direction of movement of the scanning roller. If the axis of the sliding gear controls the taps of a rotation device, the output of the rotation device will represent both X- and Y- data for path control.

In another form of the invention, a determination of the path program is accomplished by the use of a second cross sled that is movably coupled to the scanning roller. A plurality of digital generators are mechanically coupled to the second cross sled, whereby the signals provided by the digital generators representing the path coordinates of the scanning roller. The signals are fed to a sliding register (or microcomputer with sliding register characteristics) and a control circuit for the X- and Y- driving motors.

It is also possible to deduce the path coordinates of the scanning roller by electric means. To this end, electric voltages are tapped along two potentiometers arranged parallel to each of the coordinate axes. The electric voltages reproduce the position of the cross sled within the X-Y coordinate system. A further potentiometer capable of providing an output representative of an angular position is coupled to the scanning roller. The output of the potentiometer, representative of the angular position of the arm, as well as the electric voltages representative of a coordinate position of the scanning roller provide a control function.

It is advantageous to mount the processing tool, that is, the grinding head, on a cross sled and provide the processing tool with a movement capability so that the grinding head is always at a perpendicular attitude with relation to the edge of the glass pane throughout the entire all-around movement. In this manner it is possible to adjust and constantly maintain the same grinding force on the edge irrespective of the contour of the glass pane.

A simplification in the control circuit for the driving motores will be realized by maintaining the diameters of the scanning roller and grinding wheel equal. Further, it is preferable to use a torque device to maintain the scanning roller in contact with the edge of the glass pane and in this manner derive more accurate coordinate and angular rotation data.

Further characteristics and advantages of the invention will become clear as the description to be read in conjunction with a consideration of the drawing continues.

BRIEF DESCRIPTION OF THE DRAWING

FIG. 2 is a view in side elevation of a scanning apparatus for the grinding machine of FIG. 1;

FIG. 3 illustrates diagrammatically the mathematical manner of expression of the positional relationship of the scanning apparatus (a roller) and a grinding disc;

FIG. 6 is schematic illustration of structure for the regulation of grinding pressure exerted by the grinding head;

FIG. 7 is a diagrammatic illustration of a sequence of operation of a switch mechanism for control of the grinding machine;

BEST MODE FOR CARRYING OUT THE INVENTION

Figure 1:
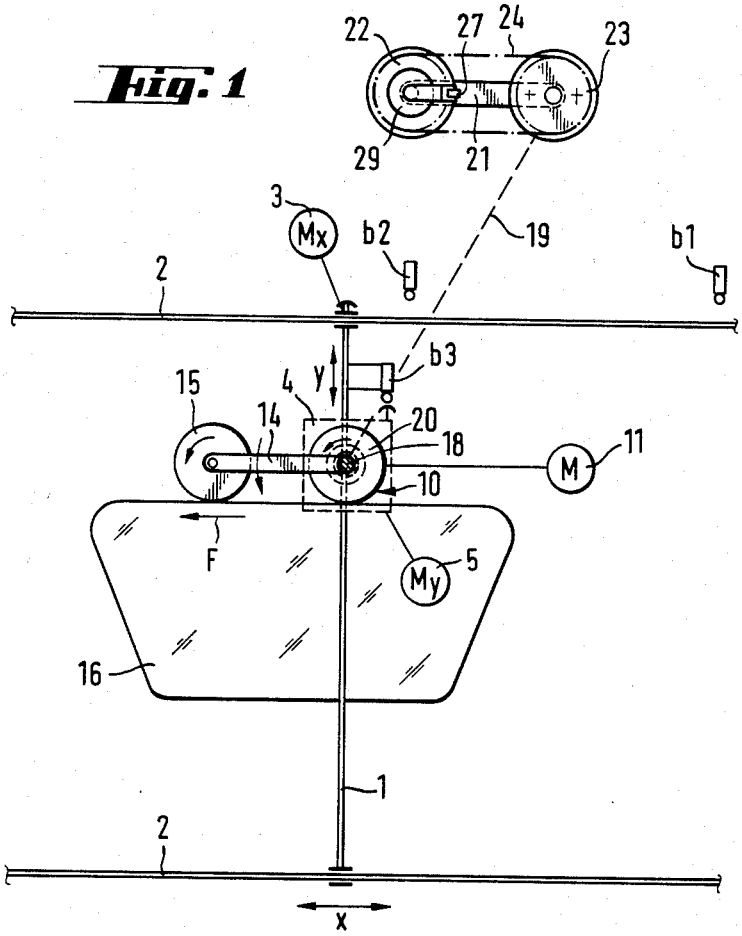
FIG. 1 illustrates schematically, and in plan view, a first form of grinding machine of the invention.

The grinding machine of the invention may be seen in schematic presentation in FIG. 1. As previously discussed, the apparatus is one which functions in moving a grinding head of an all-around grinding machine continuously, in a complete path of movement around the periphery of a glass pane for grinding the edge of the glass pane. The apparatus includes a bridge 1 and a pair of rails 2 supporting the bridge for movement back and forth in one direction of the coordinate system. The rails are arranged in a fixed, parallel relation on opposite sides of a support for a glass pane 16. Structure for support of the rails is not shown. A motor 3 provides a drive for movement of the bridge, for example, in the X-direction. The motor may be disposed on the bridge itself or on frame structure (also not shown), as desired.

The motor may be mechanically coupled to the bridge in any manner thereby to provide the necessary drive. For example, the output of the motor may be coupled to the bridge by a toothed rod disposed along one of the rails; or in the event that the motor may be disposed on the frame, movement may be coupled to the bridge by way of spindles, toothed belts or rods, driving pinions or some other power transmission structure, as may be conventional. The motor 3 is illustrated in FIG. 1 as the X-drive motor $M_x$.

A sled 4 is mounted on the bridge for movement in the other coordinate direction, that is, the Y-direction. A motor 5 provided for this purpose, may be disposed either on the sled or the bridge, and mechanically coupled to the sled to provide the necessary drive. The drive connection between the motor and the sled may be similar to the drive connection between motor 3 and bridge 1. The motor 5 is illustrated in FIG. 1 as the Y-drive motor $M_y$.

The motor 5 may also be located on the frame structure. In this adaptation a second bridge crossing over the grinding machine in the X-direction, as discussed in German Auslegeschrift No. 26 46 062, may be used in providing a drive connection for driving sled 4. To this end, the German publication discloses a pair of opposed parallel rails (like rails 2) and a further pair of opposed, parallel rails at the ends of the first pair. A bridge, the "second bridge", extends between the last-mentioned rail pair and is connected to the bridge (like bridge 1) at their intersection.

The motors 3, 5 may be impulse controlled DC current, disc armature motors having a built in speedometer machine. Motors of this type are commerically available from the firm BBC, and identified by the tradename or type M19P and F12T.

A grinding head 10 is carried on sled 4 and may be of the type described in German Auslegeschrift No. 19 66 260. According to this publication, the grinding head includes a grinding wheel or disc carried at the end of an output shaft of a motor. The grinding wheel is driven about a vertical axis. The motor is carried on a guide system supported within a housing. The guide system or sled includes a pair of spaced, parallel rods supported by the housing and a pair of slides movable along the rods. Particularly, the motor is supported on the slides for positioning movement in one direction or the opposite direction. According to the German publication a double acting cylinder comprises a contact pressure arrangement, and through action on the slides controls the position of the grinding wheel in one direction. Thus, a regulatable contact pressure exerted by the grinding wheel perpendicularly on the edge of the glass pane 16 may be established.

The motor housing is, in turn, supported within an outer housing and adapted for movement rotationally so that a regulatable contact pressure may be exerted by the grinding wheel on the edge of the glass pane in different attitudes of location of the grinding wheel during the all-around movement.

The motor is the motor 11 illustrated in FIG. 1. A control arrangement for control of the motor will be discussed below.

A roller 15 which serves as a scanning roller is located in advance of sled 4 in the direction of movement indicated by arrow F. The roller is carried on one end of an arm 14 and mounted for rolling movement along the periphery of the glass pane. The arm is capable of movement about a rotational axis 18 through the other end. The scanning roller for proper scanning of the edge of the glass pane 16 must maintain continuous contact with the edge. A motor 20 of a torque motor is disposed on a shaft 19 (see FIG. 2), coaxially arranged relative to the rotational axis 18 which may be the axis of the output shaft of motor 11. The arm 14 is connected rigidly to shaft 19, and is acted upon by a constant torque in the direction toward the edge of the glass pane.

As may be seen in FIG. 2, shaft 19 extends beyond the point of connection of the arm, and a second arm 21 is mounted at the end of the shaft. The arms 14 and 21 are disposed in a parallel plane and the arms extend from the shaft throughout a coextensive length. A shaft 25 is mounted at the end of arm 21. The axis of shaft 25 is coaxial with the axis about which the scanning roller 15 rotates. A gear 22 is rotatable around the axis of of shaft 25. A gear 23 disposed as a sun wheel is located on the sled within the inner or motor housing of grinding head 10. Gear 23 is positionally, located at a position beyond the end, but coaxially of the axis of rotation of shaft 19. A chain 24 connects the gears 22, 23 kinematically. As a consequence of the type of arrangement, while the axis of gear 22 follows the same path as the axis of scanning roller 15, the angular position of gear 22 remains unchanged during movement of the grinding machine around the glass pane.

A device 29 in the form of a rotation measuring instrument is supported on gear 22 about the shaft 25. The device is characterized as a sine-cosine potentiometer (hereafter "potentiometer"). The shaft 25 comprises the rotatable tap for the potentiometer.

An arm 26 is carried by shaft 25 at one end. The arm, in turn, supports a gear 27 which may be a so-called slide gear. The slide gear functions to roll along a plate 30 disposed horizontally above the glass pane 16 as the grinding machine moves along the periphery of the edge of the glass pane. Thus, the slide gear rolls along the fixed plate 30 as the scanning roller 15 rolls along the edge of the glass pane, and the arm 26 is turned by the slide gear in a direction of rotation opposite to the direction of movement of the scanning roller. Therefore, the direction of movement of the scanning roller is precisely determined at every increment of time. Then, if electrical values, representative of the change in angular position of the arm 26 are generated, those values may be used for control of the motors 3, 5 for driving the sled 4 in the X-Y coordinate system and for control of motor 11 which drives the grinding wheel. The change in angular position of arm 26 is converted into electrical values by movement of shaft 25, that is, the rotatable tap of potentiometer 29.

The mathematical relationship which may exist between the position of the scanning roller 15 and that of the grinding head 10 will become clear through reference to FIG. 3. This mathematical relationship forms the basis of the construction of the grinding machine. At any time, the included angle between the axis of arm 14 and the X-axis of the X-Y coordinate system is the angle $\alpha$.

This angle corresponds to the angle formed by arm 26 as it is rotated by slide gear 27 relative to the X-axis, also. The coordinate positions of the axes of the grinding wheel of grinding head 10 and the scanning roller 15 may be designated geometrically. To this end, $X_t$ and $Y_t$ are the coordinates of the position of the scanning roller at each moment of time; and $X_k$ and $Y_k$ are the coordinates of the position of the grinding wheel at each moment of time. The distance of separation of the axes of the scanning roller and grinding wheel, equal to the length of arm 14, is designated as $A_t$.

The position of the grinding wheel is related to the position of the scanning roller, as follows:

$$X_k = X_t + A_{t \cdot \cos \alpha}$$

$$Y_k = Y_t + A_{t \cdot \sin \alpha}$$

If the axes differential are determined from the X- or Y- values, then the following relationship results:

$$\frac{\Delta Y}{\Delta t} \cdot \frac{\Delta x}{\Delta t} = \frac{\Delta Y}{\Delta x} = \tan \alpha$$

Since the angle is continuously measured by the system of scanning roller and slide gear, and since the electrical value representative of the measurement is available immediately as electric voltages supplied by the potentiometer, the electric voltages may be used directly for determining the path control of the grinding head.

The potentiometer 29 that has been used successfully is a commerical structure, marketed by the firm Megatron, of Munich, West Germany under the tradename or type SCB 50. This potentiometer is a rotation potentiometer with four quadrants. Another potentiometer that has been used successfully is a potentiometer identified as V 23 401 E 0012-B 001, sold by the firm Siemens.

Figure 4:
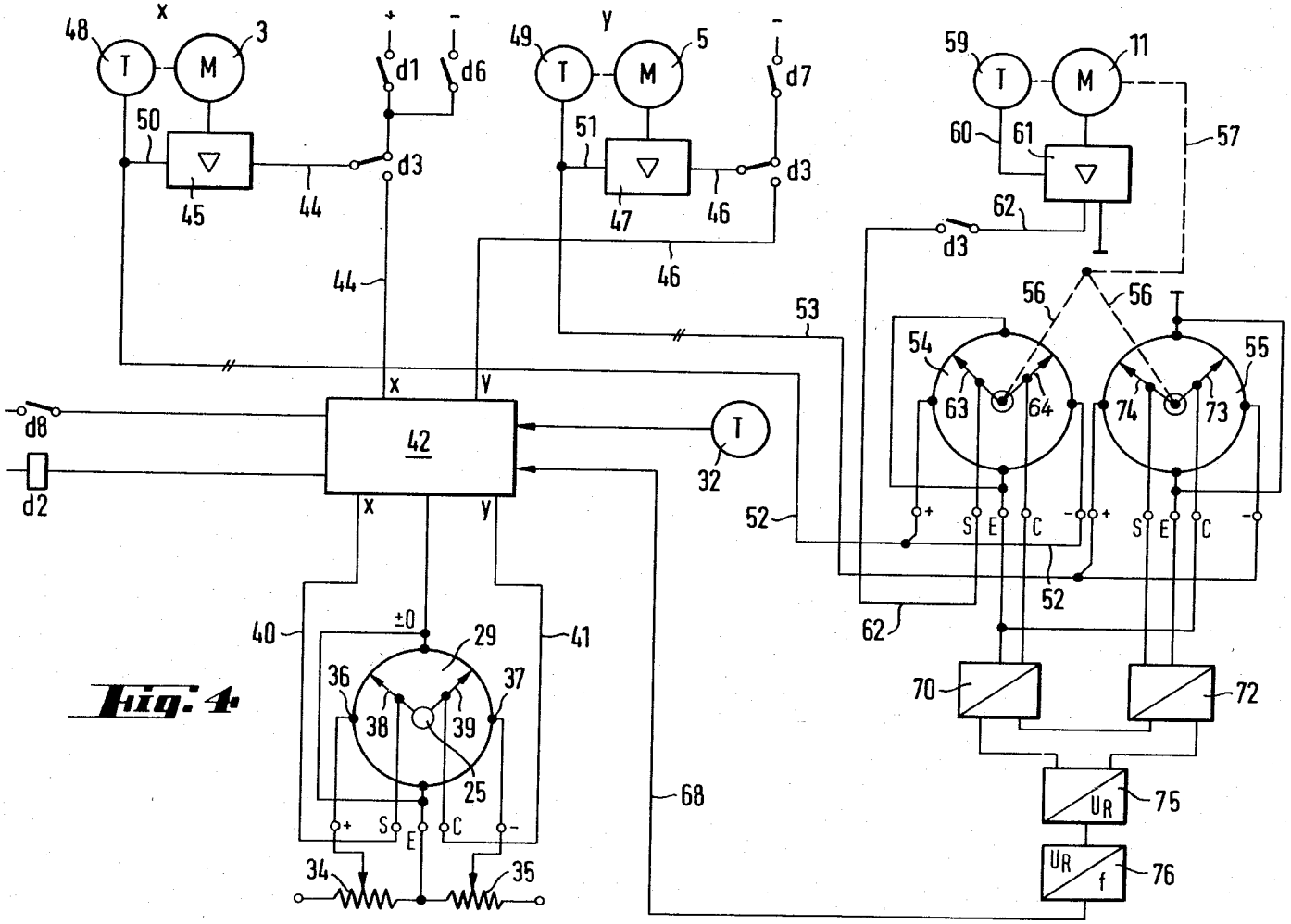
FIG. 4 is a schematic circuit diagram of an electronic control of a grinding head.

Referring now to FIG. 4, the potentiometer 29 is illustrated as comprising a pair of sliding contacts 38, 39 of a double voltage tap construction. The sliding contacts are carried by shaft 25 at a fixed relationship to enclose an angle of 90°. Thus, as shaft 25 rotates one tap will indicate the value of the sine of the angle $\alpha$, while the other tap will indicate the value of the cosine of the angle $\alpha$. Each indication is a direct indication. As previously indicated, movement of shaft 25 rotationally follows rolling movement of the slide gear 27, and the movement of arm 26.

A tachomachine 32 (see FIG. 2) is carried on shaft 19. The tachomachine functions to provide an electrical voltage output that represents and is proportional to the angular speed of rotation of shaft 19. A digital producer providing a voltage at a frequency dependent upon the angular speed of rotation of shaft 19 could be used equally as well. The output signal of the tachomachine (or digital producer) is connected to one input of a sliding register 42. This signal is used in a compensation sense when the scanning roller shall scan around a corner of the glass pane 16 thereby to expand the sliding register. If, for example, the peripheral speed of scanning roller 15 corresponds to the resulting grinding speed, that is, to the geometrical sum of the grinding speed along the X- and Y- axes, then the number of storage locations in the sliding register 42 for either the X- or Y- axis corresponds precisely to the length $A_t$ of the arm 14. If, however, the peripheral speed of the scanning roller increases so that it is greater than the peripheral speed of the grinding wheel, which is the case when the scanning roller shall scan around a corner, such as a 90° corner, and the arm 14 rotates shaft 19, then the number of storage locations in the sliding register 42 is increased. The increase in storage locations will correspond to the output signal of tachomachine 32. The signals of the potentiometer 29 which represent the value of the sine and the cosine, of the angle $\alpha$ are connected to additional input terminals of sliding register 42. The input at terminal x, from tap 38 is connected on line 40; while the input at terminal y, from tap 39, is connected on line 41. A pair of control devices 45, 47 for driving motors 3, 5, respectively, are connected at the output of the sliding register. The signals at the output terminals x and y, phase-shifted in the manner of their phase-shiftat the input terminals, function as theoretical value signals. The connections between the output terminals of sliding register 42 and the control devices 45, 47 are provided by lines 44, 46, respectively.

Each control device may be a timed, four quadrant-transistor speed control, such as the construction series SMC, type 280A, of the firm Hauser-Elektronik.

Tachomachines 48, 49 are mechanically coupled directly to motors 3, 5, and electrically connected to the regulating devices 45, 47, respectively. Each tachomachine develops an output signal voltage which corresponds to the actual speed of rotation of the output shaft of the motor to which it is coupled. The electrical connection of tachomachine 48 and regulating device 45 is over line 50, and the electrical connection of tachomachine 49 and regulating device 47 is over line 51. The voltage output of each tachomachine is compared with the theoretical value control voltage on the respective lines 44, 46 and is utilized for the control of motors 3, 5.

The voltage output of tachomachines 48, 49 is also utilized in the control of motor 11 and grinding head 10. The voltage output, also, provides a control signal in the positioning of the inner housing of the grinding head and the sled which carries the motor 11 and grinding wheel thereby to locate the grinding wheel so that the contact pressure between the grinding wheel and the edge of glass pane 16 acts perpendicularly relative to the edge. The control of motor 11 and grinding head 10 is provided by potentiometers 54, 55 which, like potentiometer 29, are sine-cosine potentiometers.

Potentiometers 54, 55 are triggered by the voltage output of tachomachines 48, 49 over lines 52, 53, respectively. The potentiometers 54, 55 may be disposed in a single housing, including a pair of taps that rotate about a common shaft. As illustrated in FIG. 4 however, the potentiometers may also be mechanically coupled to one another by a mechanical connection 56 and, in turn, mechanically connected to shaft 57 of motor 11 of the grinding head 10 so that there is synchronism of rotation of both shafts or the single shaft of the potentiometers and the grinding head.

A tachomachine 59 is mechanically coupled to motor 11 and electrically connected to a regulating device 61. The tachomachine develops an output signal voltage which corresponds to the actual speed of rotation of the grinding head. The electrical connection of the tachomachine and regulating device is over line 60.

Potentiometer 54 provides an X-axis control and potentiometer 55 provides a Y-axis control. The potentiometers are also interlinked electrically in a differential circuit. In operation, a theoretical value voltage is developed at tap 63 of potentiometer 54. This theoretical value voltage provides one theoretical value voltage input to regulating device 61. The input is over line 62. This circuit drives motor 11 in a manner which corresponds to the predetermined theoretical value voltage over line 62 and the actual value voltage over line 60. If the position of the head rotation is correct, the theoretical value voltage from potentiometer 54 is zero.

The potentiometers 54, 55 provide another function. To this end, the potentiometers function to accomplish correction of the effective grinding speed. The potentiometers, also, influence the timing frequency of the sliding register 42. As to the latter function, the potentiometers are connected by line 68 to the sliding register.

The position of taps 63, 64 of potentiometer 54 and taps 73, 74 of potentiometer 55 are positioned by motor 11 through the mechanical couplings 56, 57. The position of the taps and the output signal voltage from tachomachine 48 serve in the correction previously mentioned. To this end, the voltage in the switching member 70 is the voltage from tachomachine 48, through potentiometer 54, and the voltages from taps 64 and 73. Tap 73 connects the tachomachine 49, potentiometer 55 and switching member 70. This voltage at switching member 70 corresponds to the value $\cos^2 U_x$. The voltage in the switching member 72 corresponds to the value $\sin^2 U_y$. To this end, the voltage in the switching member 72 is the voltage from tachomachine 49 through potentiometer 55, multiplied with the voltage from tap 74.

The switching members 70, 72 are galvanic separating members. Particularly, the switching members are DC current switching transformers, for purposes of avoiding disturbing reactions as a result of electrical interconnection. The switching members have their outputs in series connection to provide a summation voltage according to the function $\cos^2 U_x + \sin^2 U_y$. This summation voltage in reality is the resulting voltage $U_r$ which corresponds to the resulting grinding speed. The summation voltage provides an input voltage to switching member 75, and an input to the timing generator 76. The output of the timing generator is a theoretical value for the timing frequency. As such, the output of timing generator 76, on line 68, times the sliding register 42. If there is a change in grinding speed, for example, as a result of a shift of the predetermined theoretical value to potentiometers 34, 35, the sliding contacts of which are connected to potentiometer 29, then the circuit heretofore described will time the sliding register by either an increase or decrease in the timing frequency. The result of the timing operation is to maintain the speed-time-product constant.

As illustrated in FIG. 4, the sliding contacts of potentiometers 34, 35 are connected to terminals 36, 37, respectively, of the potentiometer 29.

The sliding register 42 may effectively be a component of a microcomputer.

Figure 5:
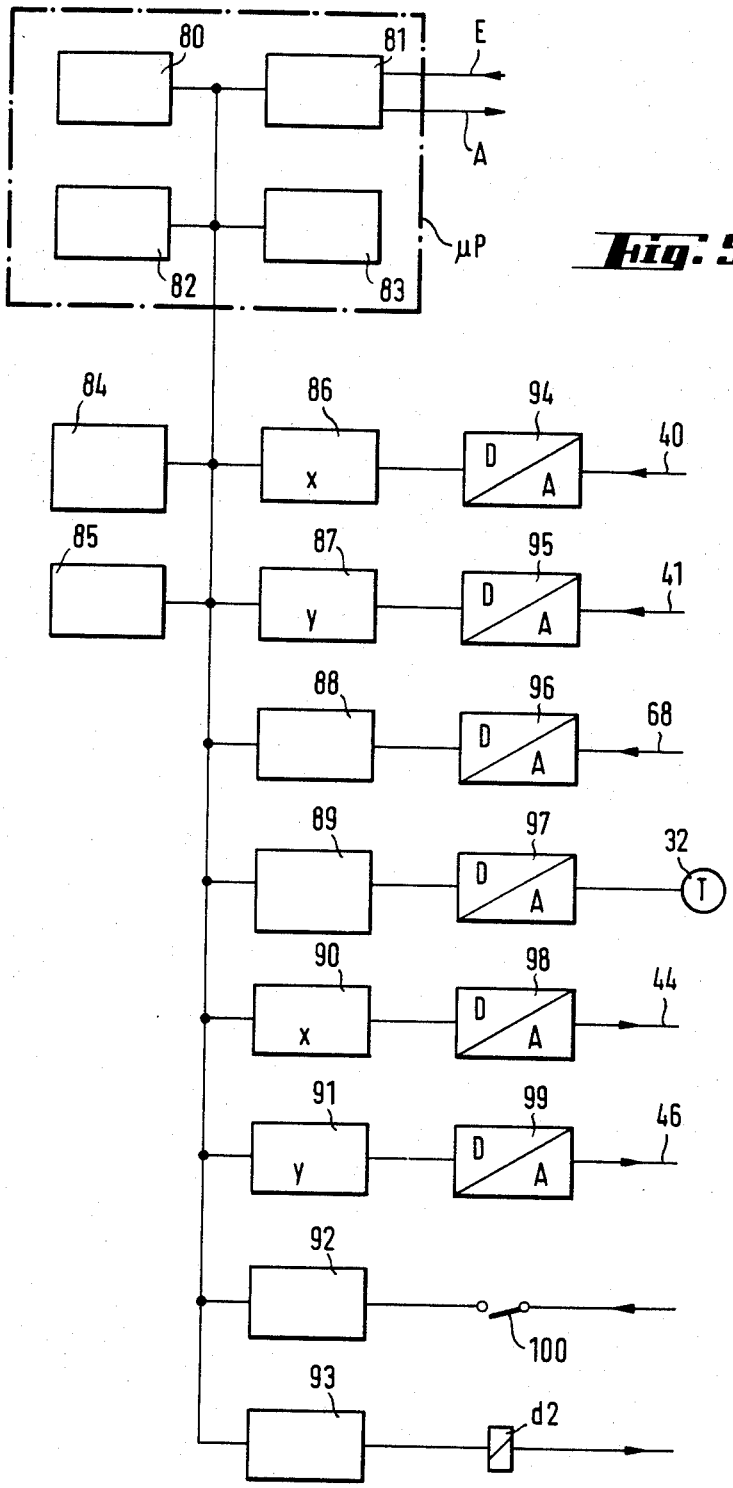
FIG. 5 is a block circuit diagram of a microcomputer for the electronic control of FIG. 4.

Referring now to FIG. 5, there is illustrated a block schematic presentation of a microprocessor for electronic-path control for a grinding machine. The microprocessor system ($\mu$P) includes the actual central unit 80 of the microcomputer, an input and output unit 81, a RAM storage 82 and an EPROM storage 83.

The microprocessor may be a type 8085 microprocessor of the firm Intel.

The units of the microprocessor system are connected to a bus system, as are several peripheral units of the overall system, and the input and output unit is connected to the operating device over line E and to an indicator unit over line A.

The peripheral units include a RAM storage enlargement unit 84 and an interrupt processing unit 85.

The EPROM storage 83 is capable of retaining the content of data in the event of an interruption of the supply voltage, and the storage may be erased, for example, by ultraviolet radiation. On the other hand, the RAM storages are not capable of retaining the content of data when there is a loss of the supply voltage.

A plurality of interface units 86–93 are connected to the bus system. Thus, unit 86 between an analog/digital converter 94 and the bus system serves to interface the adaptation of the voltage value $\sin_x$ from potentiometer 29 (FIG. 4) on line 40. A unit 87 between an analog/digital converter 95 and the bus system provides the same function with the voltage value $\cos_y$ from potentiometer 29 on line 41.

The microcomputer is programmed so that it displays the characteristic of an extendable register. This function is achieved by processing the electrical voltage output of tachomachine 32 both representing and proportional to the angular speed of rotation of shaft 19 (FIG. 2), and the output of timing generator 76 which is a theoretical value summation voltage for the timing frequency. A unit 88 between an analog/digital converter 96 and the bus system adapts the timing frequency on line 68, which frequency is identical to the feeding in or delivery timing of the microcomputer. A unit 89 between an analog/digital converter 97 and the bus system enlarges the sliding register with the electrical voltage output of the tachomachine. All of the signals to the analog/digital converters 94–97 are digitized and connected to the bus system of the microcomputer by the interface, as discussed.

The sliding register 42, then, whose timing is controlled by the timing frequency of timing generator 76 will provide an output at the X and Y output terminals at a time corresponding to the required temporal delay under control of the timing generator. Thus, the value $\sin_x$ on line 40, digitized at the input terminal X of the sliding register appears at the output terminal X of the sliding register and line 44 which connects the sliding register and regulating device 45. There is an interface 90 at the output and the signal to line 44 is returned to the previous analog state by the digital/analog converter 98 for control purposes. The same series of operations occur with respect to the signal at the input Y of the sliding register. This input, first digitized, then delayed by the operation of the timing generator 76, appears at the output for control of the regulating device 47. The control is provided by a signal that is returned to the analog state by the digital/analog converter 99 connected to interface unit 91. The analog signal appears over line 46.

An interface unit 92 is located between a contact 100 and the bus sytem. The interface serves to connect an erasing signal to the sliding register 42. The erasing signal is triggered by operation of the switch to a closed position under control of relay d8 (see FIG. 8). This will be described when considering that Figure.

An interface 93 connects the bus system and relay d2 for control of the relay and the switches it controls. The relay d2 which may be seen in FIG. 8, also, provides the function of signalling that both axes of the sliding register are filled, and that the sliding register is in a state of readiness.

As previously discussed, the grinding motor and grinding wheel are mounted for movement in directions relative to the axis of the inner housing of the grinding head 10. It was the function of this movement capability of aligning a mounting sled in a perpendicular orientation with respect to the edge of the glass pane. Movement in the alignment of the grinding head 10 is with the assist of the head rotating motor 11 (FIG. 4).

The arrangement in the alignment of the grinding head may be seen in FIG. 6. Referring to the Figure, there is a schematic illustration of a sled 107, a motor 106 for the grinding wheel and a pair of rails 109 for mounting the sled. The sled is mounted on the rails by a plurality of ball bushings 108 for movement in one direction or the other. The sled is supported by the ball bushings at the corners for full freedom of movement.

A torque motor 110 functions to adjust the contact pressure acting between the grinding wheel and the edge of glass pane 16. A spindle 112 mounts the motor and the drive of the motor is operative to move sled 107 through the mechanical connection provided by the spindle 112.

A regulator 114 is connected to a power load cell 117 and a potentiometer 115 having capability of adjustment. The output of the regulator is connected to torque motor 10 through a terminal switch P2. The regulator serves as a control of the contact pressure under control of a theoretical value signal at the input terminal connected with the potentiometer. This control is responsive to an actual value signal corresponding to the actual value of the mechanical contact pressure over line 119 connecting the power load cell and the other input terminal of regulator 114.

Figure 8:
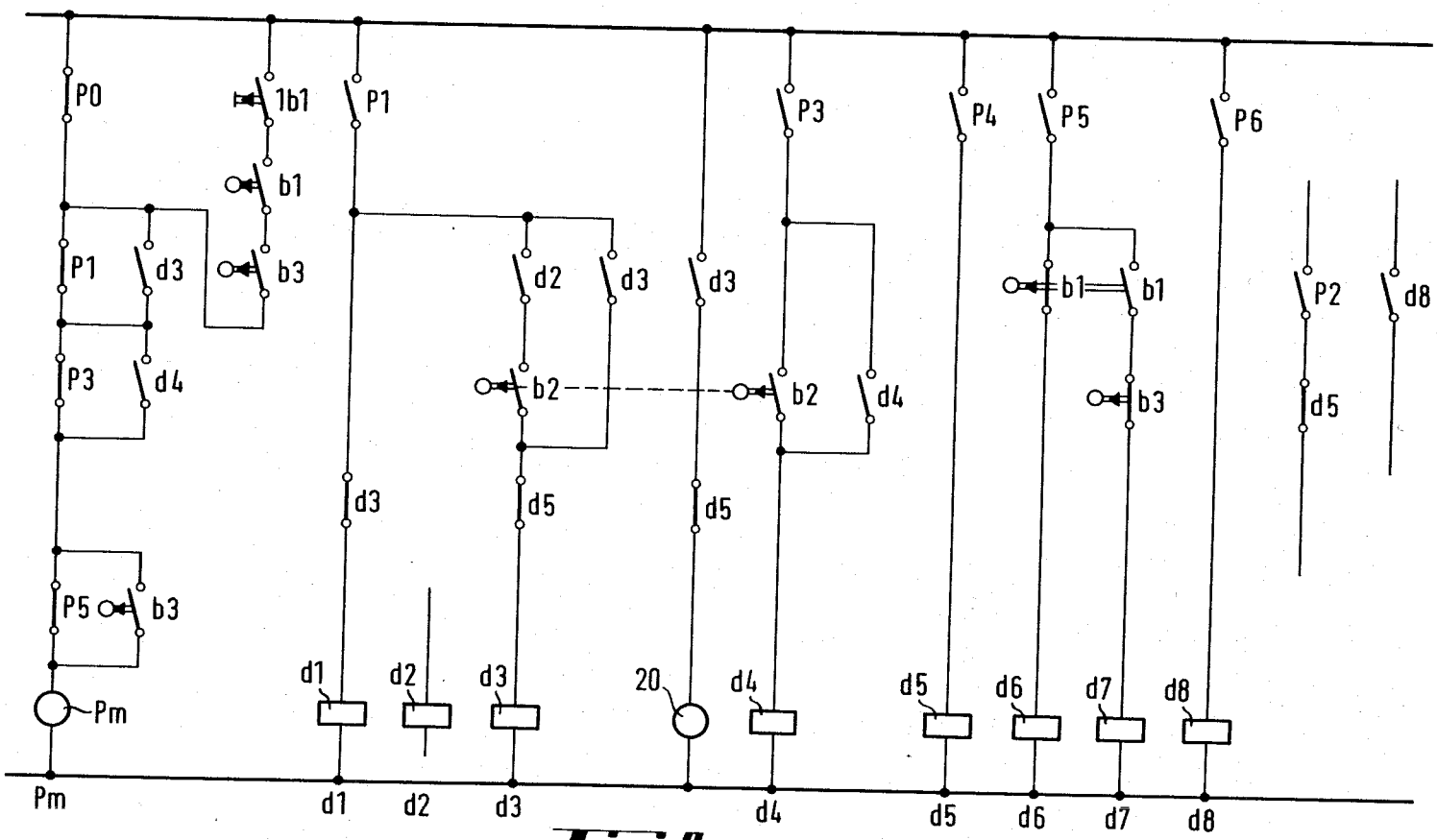
FIG. 8 8 is a schematic illustration of current flow for control of the grinding machine.

The operation of the grinding machine and its control may be fully appreciated by reference primarily to FIGS. 7 and 8 considered in conjunction with the discussion to follow. An essential component of the control is a programming switch mechanism having a programmable programming roller (hereafter "roller") driven by a motor $P_m$ (see FIG. 8). The roller (not shown) includes on its surface a plurality of cam surfaces, with each surface arranged for operating one of a series of terminal switches P0 to P6. The time of operation of each terminal switch is controlled by the position of the respective cam surface and the period during which each terminal switch is operated upon each complete revolution of the roller is controlled by the profile of the respective cam surfaces. A sequencing operation of the several terminal switches P0 to P6 according to the angular position of the roller is illustrated diagrammatically in FIG. 7.

In the rest position, sled 4 of the grinding machine is located to a position that limit switch b3 is closed, and the bridge 1 is located to a position that switch limit b1 is closed, also. The switch b1 is carried by the frame of the grinding apparatus, while the switch b3 is carried by the bridge. In the rest position, the arm 14 which supports the scanning roller 15 is aligned along the X-axis. The position of the remaining switches including the terminal switches and relay switches, when the grinding machine is in the rest position, are disposed in the normally open or normally closed condition as illustrated in FIG. 8. The one exception is terminal switch P0 which throughout substantially a full revolution of the roller is closed. This terminal switch is in the open condition for a relatively small angular rotation of the roller. Referring to FIG. 8, then, it will be seen that the terminal switch P0 is in the open condition for a small angular rotation of the roller as it approaches a full 360° revolution and for a small angular rotation of the roller as the roller begins a cycle and each subsequent cycle of operation. When terminal switch P0 is open, the main circuit path through terminal switch P0 connecting motor $P_m$ to a source of power is open, also.

When there shall be a start signal, scanner switch 1b1 will be closed to connect motor $P_m$ to the source of power through the circuit including the limit switches b1, b3, the scanner switch, and terminal switches P1, P3 and P5. The motor $P_m$, thus, begins to drive the roller in the control of terminal switches P0 to P6.

As indicated, upon a small rotational displacement of the roller, terminal switch P0 will close and for the period of time until the next terminal switch will be sequenced power to motor $P_m$ will be through the circuit including terminal switch P0. The start signal, however, must be more than a momentary signal, so that the motor $P_m$ is able to commence its drive and the roller is able to rotate through a rotational angle sufficient to allow terminal switch P0 to close. The limit switches b1 and b3 will remain closed since neither the bridge nor the sled will have moved under control of motors 3, 5, respectively.

When the roller has rotated through an angular rotation equal to about 20° (see FIG. 7) the contacts of terminal switch P1 which normally are open, close and the contacts in the main circuit path which normally are closed, open. The sequencing terminal switch P1 functions to energize relay d1 through the circuit connection including the normally closed relay contact d3. The sequencing of terminal switch P1, also, opens the main circuit and the motor $P_m$ stops. Relay d1 activates the relay switch d1 to a closed position to connect motor 3, through relay switch d3 (see FIG. 4) to a positive voltage. The motor then begins to drive the sled from the rest position in movement along the X-axis in the direction of arrow F (see FIG. 1). The speed of movement of the sled in the X-direction is determined by a positive theoretical value voltage. The length of traverse of the sled in the X-direction will be through a distance which corresponds at least to the length ($A_t$) of the arm 14 of the scanning roller 15.

As sled 4 and scanning roller 15, and the auxiliary scanning roller system including the structural components 21–27 and 29, move in the X-direction the sine and cosine voltage signals of potentiometer 29 are continually connected to the sliding register 42 along lines 40, 41. These voltage signals serve to fill the sliding register with data corresponding to the location of the scanning roller in the coordinate system. As soon as either the X-axis or Y-axis register component is filled, relay d2 is energized.

It will be recalled that relay d2 is triggered by the output of interface unit 93, with the result that the relay switch d2 closes. When relay d2 becomes energized, sliding register 42 is conditioned to release the data from one register component or the other, or both register components. As bridge 1 continues movement in the direction of the arrow F, the bridge will operate the switch b2.

Switch b2 is a ganged switch having contacts in the circuit to both relays d3 and d4. At the time bridge 1 closes the switch b2, the circuit to relay d3 becomes energized through relay switches d2 and d5, and the switch b2. Relay d3, then, functions to control the relay switches d3. As a result of this action, the motor $P_m$ begins to drive the roller through the completed main circuit path, and the relay switches d3 connect the regulators 45, 47 to the X-Y terminals of sliding register 42, rather than the positive theoretical value voltage. To this end, energization of relay d3 causes relay switch d3 in the circuit to relay d1 to open. Relay d1 is deenergized and relay switch d1 likewise opens to open the connection to the positive theoretical value voltage. The relay d3 also closes the circuit through relay switch d5 to the torque motor 20 which functions to swivel the arm 14 and scanning roller 15 in the direction toward the edge of the glass pane 16 thereby to hold the scanning roller in a continuous condition of contact with the edge. Finally, the relay d3 functions to complete the circuit to motor 11 of grinding head 10.

When the relay switch d3 switches the input of regulators 45, 47 to the X-Y outputs of sliding register 42 along lines 44, 46, respectively, the sliding register will take over the continued control of the drive of motors 3, 5.

The motor $P_m$ continues to drive the roller, and upon an angular rotation of about 45° the terminal switch P2 is activated to the closed position. Terminal switch P1 remains closed throughout this rotation and while either the relay d2 may be deenergized if the X-axis component or Y-axis component of the sliding register 42 is not filled or the switch b2 may be opened, or both the switch b2 and relay switch d2 may be opened, the circuit to relay d3 is closed through the holding relay switch d3 and relay switch d5. During substantially the time that terminal switch P2 is closed, torque motor 110 (see FIG. 6) will be operative so that a grinding pressure is exerted by the grinding wheel on the edge of the glass pane.

The terminal switch P2 will be closed by the programming roller at about the time the sliding register 42 controls the motors 3, 5, rather than the control being a positive or negative theoretical value voltage.

At about 70° rotation of the programming roller, terminal switch P1 in the circuit to relay d1 opens and the terminal switch in the main circuit path to motor $P_m$ closes. This action is followed by deenergization of relay d3 whereupon the relay switches return to the positions in FIG. 8. Thus, the relay d1 is energized through the normally closed relay switch d5 thereby to reconnect the regulators 45, 47 to the theoretical value voltages and disconnect the regulators from the control provided by sliding register 42. Further, motor 20 ceases operation and the connection between potentiometer 54 and motor 11 opens.

When the programming roller has rotated through about a one-half turn the terminal switch P3 in the circuit to relay d4 will close and the terminal switch in the main circuit path will open. According to these actions, the motor $P_m$ will stop and remain stopped until such time as bridge 1 again actuates switch b2 upon return of the bridge in the direction of the start of travel. Operation of switch b2 therefore, means that sled 4 has travelled completely around the glass pane. The switch b2, when it closes, functions to complete the circuit to relay d4. The energized relay causes the relay switches d4 to close. The relay switch in the main circuit path closes to restart the motor $P_m$ and closes the holding circuit to relay d4. The relay, thus, remains energized even if switch b2 should open. When the programming roller has rotated through about 250° of angular rotation the terminal switches P3 will return to the normal position illustrated in FIG. 7, thereby to maintain operation of motor $P_m$ and to deenergize relay d4. The motor $P_m$ shall continue to drive the programming roller through about 260° angular rotation to operate terminal switch P4. Terminal switch P4 will close to energize relay d5. The relay d5 functions to reverse the direction of rotation of the torque motor 110 (see FIG. 13) in regulating the grinding pressure and to return the grinding head to the starting position. In addition, the torque motor 20 is turned off by the contacts P4 and relay d3 is deenergized. The regulators 45, 47, thus, are separated from sliding register 42.

As the programming roller continues to rotate, the terminal contact P2 opens (at about 270° angular rotation) and terminal contact P5 closes. Terminal contact P5 closes at about 300° angular rotation.

Terminal contact P5 functions to open the main circuit path and the motor $P_m$ is stopped, once again. The terminal contact P5, further, energizes relay d6 through the normally closed contacts of switch b1. Relay d6 activates relay switch d6 to close the circuit, through relay switch d3, between the negative value theoretical voltage and regulator 45. The negative value theoretical voltage causes bridge 1 to travel back in the X-direction into its rest position. As a result of this movement the normally closed contacts of switch b1 open and the normally open contacts close. The relay d6 is deenergized and simultaneously the relay d7 is energized through terminal contact P5 and switch b1. Relay switch d7 closes thereby to connect regulator 47 to a negative theoretical value voltage. The voltage acting on regulator 47, through relay switch d3 causes the sled 4 to travel backward in the Y-direction, that is, toward switch b3. Switch b3 functions to open the circuit to relay d7 which deenergizes, and to complete the main circuit path so that motor $P_m$ resumes the drive of the programming roller.

At about 325° of angular rotation of the programming roller, the terminal switch P6 is closed. Terminal switch P6 completes the circuit to relay d8 which is energized. The relay switches d8 provide an erase signal at an input of sliding register 42. The relay contact also functions to return the arm 14 and the scanning roller to a reset position at which the scanning roller is removed from contact with the glass pane.

Motor $P_m$ continues the drive of the programming roller to cause each of the terminal switches P4, P5 and P6 to open at about 350° angular rotation. The motor $P_m$ continues the drive to the programming roller until such time as terminal switch P0 opens. The operation, then, ceases and the programming motor signals an end of a grinding cycle. Since the switches b1 and b3 are closed a new grinding cycle may be started by closing the starting scanner 1b1.

The operation of the grinding apparatus, as described, is one wherein the potentiometer 29 serves as the measuring instrument for determining the path of the scanning roller 15, and assists in the determination of the relationship of the speed of movement in the X- and the Y- directions of the coordinate system. More particularly, the values of voltage corresponding to the sine and cosine values of the potentiometer, representing the path coordinates of the scanning roller, after having been converted to a corresponding digital value, are stored in the sliding register.

It is possible, however, to determine the path coordinates of the scanning roller in a different manner. To this end, the position of the scanning roller in the coordinate system, for example, may be determined directly by digital producers with the help of an auxiliary coordinate system.

Figure 9:
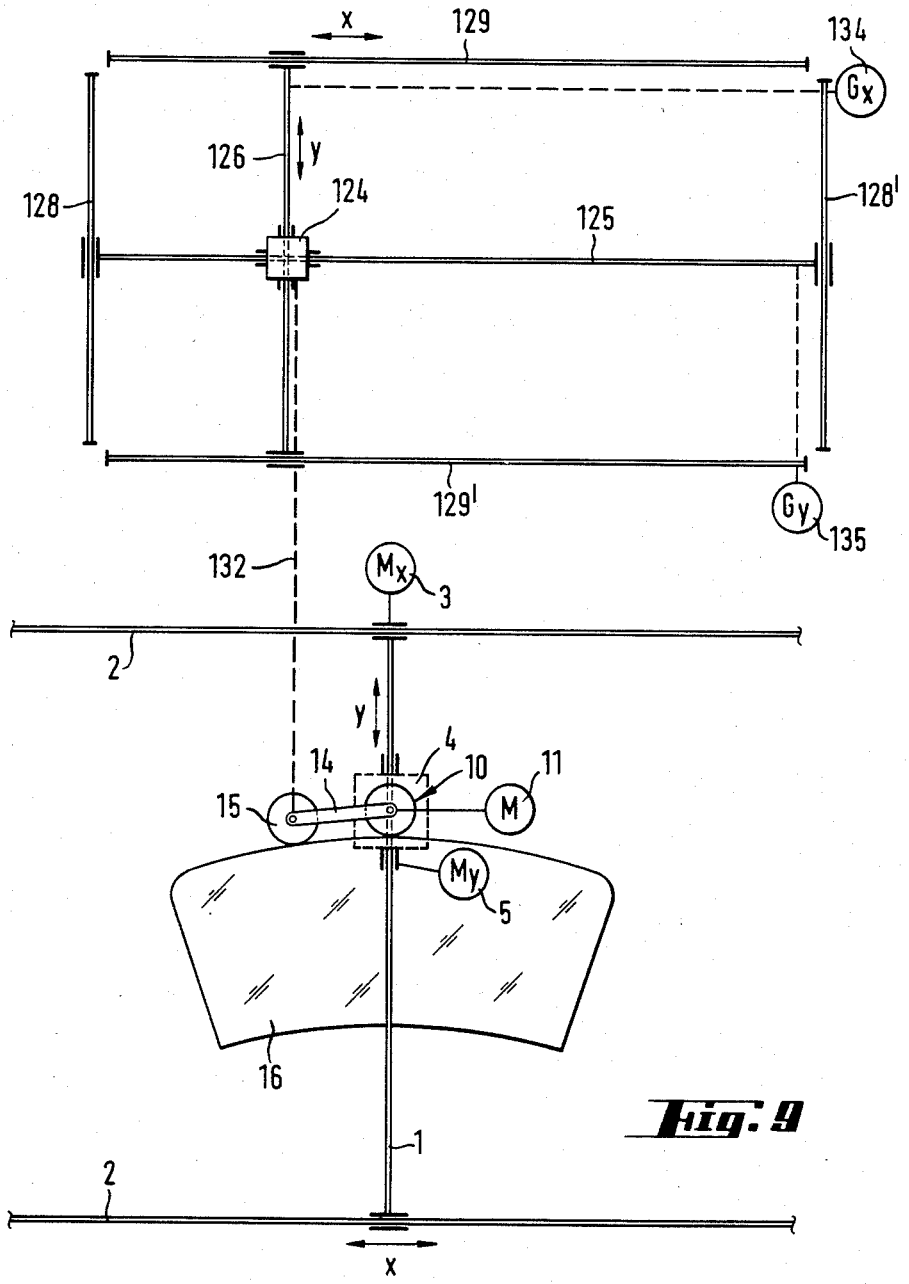
FIG. 9 illustrates schematically, and in plan view, a second form of grinding machine of the invention.
Figure 10:
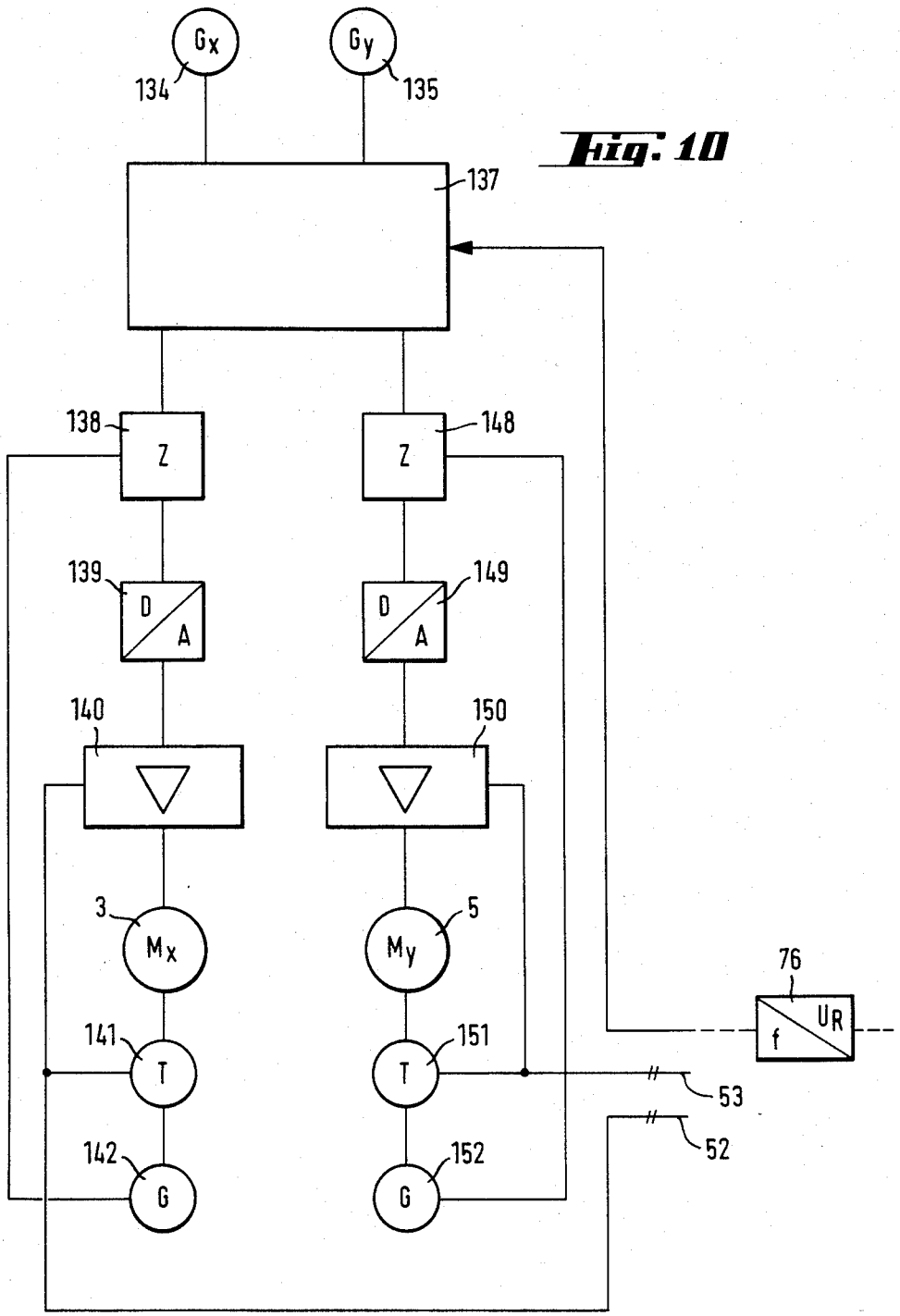
FIG. 10 illustrates in block form the evaluation and control electronics for a pair of servo motors of the grinding head of the form of grinding machine of FIG. 9.

Referring to FIGS. 9 and 10, there is an illustration of the second form of grinding machine and an illustration of an evaluation and control electronics package which will serve to assist in describing the operating principles.

Figure 11:
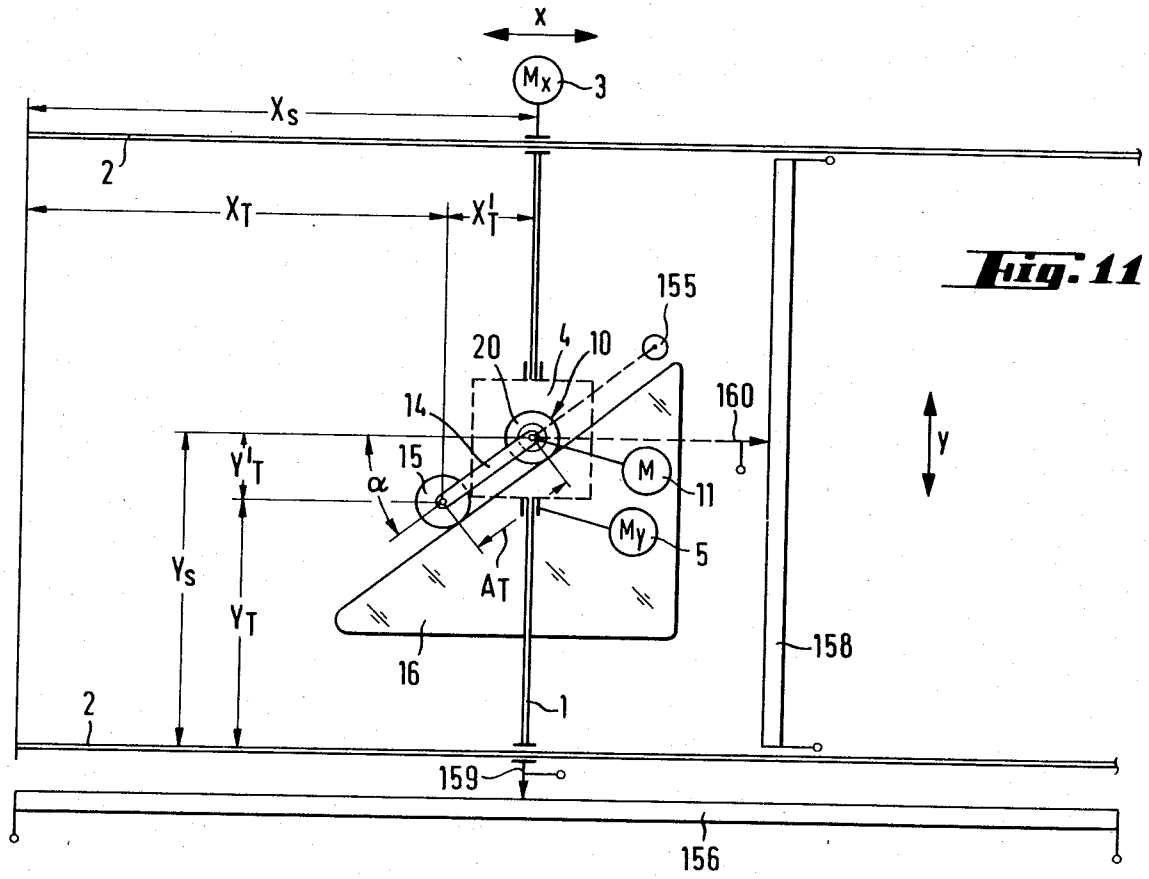
FIG. 11 illustrates schematically, and in plan view, a third form of grinding machine of the invention.
Figure 12:
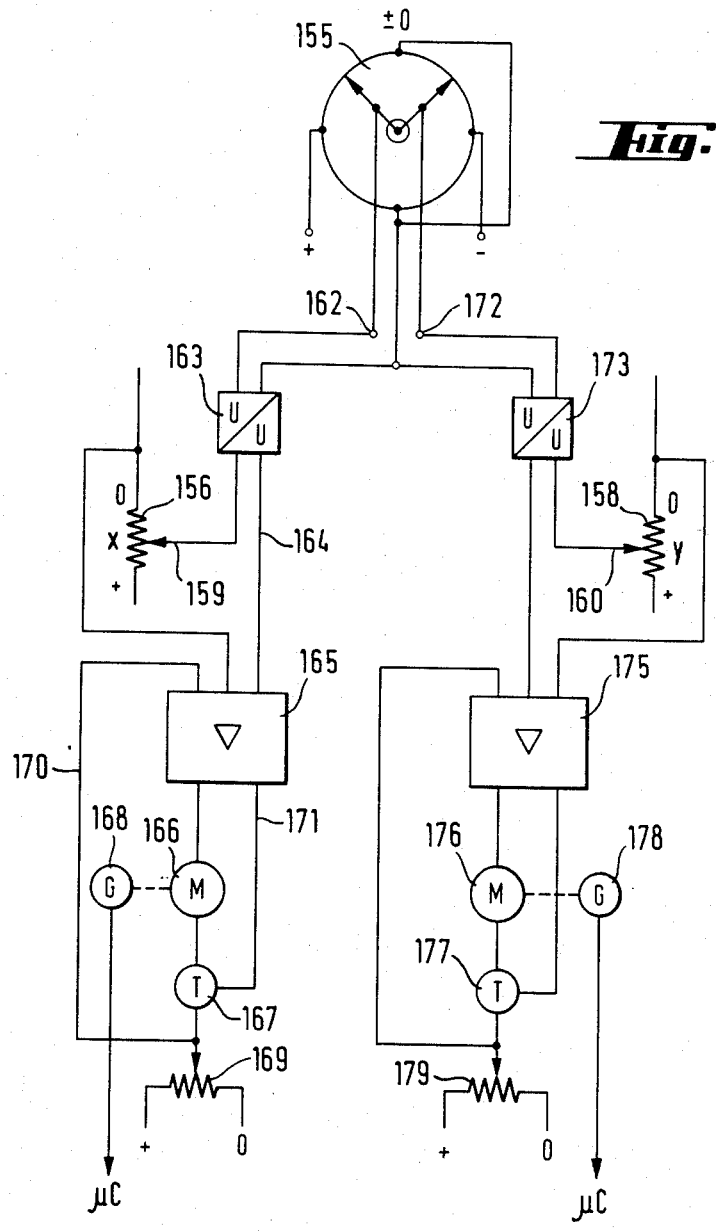
FIG. 12 illustrates in block form the evaluation and control electronics for the positioning of the scanning roller and for a pair of servo motors of the grinding head of the grinding machine of the form of grinding machine of FIG. 11.

It will also be seen, with reference to FIGS. 11 and 12, that it is possible to determine the path coordinates of the scanning roller with the help of electronic construction elements.

Referring now to FIGS. 9 and 10, the grinding apparatus includes a bridge 1 movable along rails 2, and a sled 4 movable along the bridge. As previously discussed in relation to FIG. 1, the bridge is movable in the X- direction and the sled is movable in the Y- direction within the X-Y coordinate system. The grinding apparatus includes a scanning system formed by a scanning roller 15 and arm 14 which mounts the scanning roller on sled 4. A motor 3 drives the bridge and a motor 5 drives the sled. A motor 11 provides a drive to grinding head 10 in a manner that the grinding head develops a contact pressure between a grinding wheel and the edge of a glass pane 16. The manner of mounting the motors and their mechanical connection may be as previously discussed.

A second cross sled apparatus is disposed in a plane both above and parallel to the plane of movement of sled 4.

The second cross sled apparatus includes a sled 124 and a pair of bridges 125, 126 which mount the sled. The second cross sled apparatus also includes a pair of spaced rails 128, 128′ parallel to the bridge 126, and a pair of spaced rails 129, 129′ parallel to the bridge 125. The rails are supported in fixed position. The bridges are movably mounted on the respective rail pairs and guided in movement by scanning roller 15. To this end, the scanning roller and sled 124 are mechanically coupled by a rod 132, whereby the sled follows a path of movement that corresponds to the path of movement of the scanning roller in following the edge periphery of the glass pane.

A digital generator 134 and a digital generator 135 are mechanically coupled to the bridges 126, 125, respectively. Thus, the digital generator 134 is responsive to movement of sled 124 in the X- direction, and digital generator 135 is responsive to movement of the sled in the Y- direction. The mechnical connection may be completed by the use of pinions and a toothed rack. To this end, a pinion may be disposed on the rotor of each digital generator thereby to mesh with the toothed rack disposed on the rails 128', 129, for example.

Other arrangements of the digital generators may be resorted to, as well. In addition, other arrangements for mechanically coupling the digital generators to the sled.

The digital generators 134, 135 may be rotational pulse generators having forward-backward recognition. To this end, a forward recognition of the sled 124 may result in a series of positive voltage impulses, while a backward recognition of the sled may result in a series of negative voltage impulses. The reverse situation may exist, as well.

Referring to FIG. 10, the voltage impulses of the digital generators 134, 135 are connected to two input terminals of a microcomputer 137. The microcomputer has a sliding register capability. In the manner of the first form of grinding apparatus, a timing generator 76 provides a theoretical value timing frequency which is connected to the other input terminal.

The microcomputer 137 processes the control signals and, under control of timing generator 76, provides an output which is connected to a pair of forward-backward differential counters 138, 148.

The counter 138 is connected to a digital/analog converter 139 and the analog value representative of the control signal is connected to amplifier 140. The signal controls the rotationalspeed and direction of motor 3 for driving sled 4 in the X- direction.

A tachomachine 141 is mechanically coupled with the drive motor 3 and provides an output comprising an analog value signal which corresponds to the actual speed of rotation of the output of the motor. The output of the tachomachine is connected to the amplifier 140 and provides an actual value voltage for comparison with a theoretical value voltage at the input of the amplifier from the converter 139. An impulse producer 142 also mechanically coupled with the drive motor 3, serves the function of returning the counter to zero at the end of the path of the grinding head.

The motor 5 is controlled in a similar manner. To this end, the signal from the forward-backward differential counter 148 is connected to a digital/analog converter 149, and the analog value voltage representative of the control signal is connected to amplifier 150. This signal controls the rotational speed and direction of drive motor 5 for driving sled 4 in the Y- direction.

A tachomachine 151 is mechanically coupled with the drive motor 5 and provides an output comprising an analog value signal which corresponds to the actual speed of rotation of the output of the motor. The output of the tachomachine is connected to the amplifier 150 and provides an actual value voltage for comparison with a theoretical value voltage at the input of the amplifier from converter 149. The actual value voltage is also connected to line 53.

An impulse generator 152, also mechanically coupled with the drive motor 5, serves to return the counter to zero at the end of the path of the grinding head. To this end, both impulse generators 142, 152 function to deliver the number of control impulses of the required sign so that the counters are returned to zero for commencement of a grinding operation from the exact starting position.

The control of the grinding machine of the form of the invention in FIGS. 9 and 10 may follow the manner of control of the grinding machine heretofore described in relation to FIGS. 4–8.

The actual voltage outputs of tachomachines 141 and 151, appearing on lines 52 and 53, respectively, thus, are used for the control of the motor 11 of grinding head 10 through potentiometers 54, 55 (FIG. 4).

The voltages tapped from potentiometers 54, 55, also, will serve in the control of the timing frequency generator 76 for determining the timing of microcomputer 137. The microcomputer, having a sliding register characteristic, has a storage empty place suppression capability simultaneously in the component registers for both the X- and Y- axis. If this was not the case, surges in the advance speed may occur whenever an empty place in one component coexisted with an empty space in the other component.

Referring now to FIGS. 11 and 12, there is an illustration of yet another form of grinding machine of the invention.

While in the form of the invention of FIGS. 9 and 10 there was a need for a second cross sled for purposes of determining the position of the scanning roller within the X-Y coordinate system, the form of the invention of FIGS. 11 and 12 functions in the determination of the position of the scanning roller in an electrical manner.

The overall constructional make-up of the grinding machine of FIGS. 11 and 12, in most regards, substantially duplicates the constructional make-up of the grinding machine of FIGS. 9 and 10. To this end, there is a bridge 1 movable along rails 2 in the X- direction, and a sled 4 movable along the bridge in the Y- direction. A motor 3 is used to drive the bridge and a motor 5 is used to drive the sled. The scanning system includes an arm 14 and a scanning roller 15 carried by the arm in a position to roll along the edge of a glass pane 16. The arm is carried by sled 4 and a torque motor 20, which acts upon the arm, is used to maintain the scanning roller in the position of contact with the edge of the glass pane to be scanned. A motor 11 provides a drive input for rotating the grinding head 10 thereby to orient the grinding head to various positions so that the grinding disc not only acts on the edge of the glass pane in a perpendicular direction, but also develops a constant pressure between grinding wheel and the edge. The motors 3, 5 and 11 are mounted in the same manner as previously discussed thereby to carry out their prescribed function.

A sine-cosine potentiometer 155 (hereafter "potentiometer") is coupled to arm 14 and responds to rotational movement of the arm. A potentiometer 156 is disposed adjacent and parallel to one of the rails 2, and a potentiometer 158 is disposed parallel to bridge 1. The potentiometer 156 is positioned to respond to movement of the bridge in the X- direction, and the potentiometer 158 is positioned to respond to movement of the sled 4 in the Y- direction. Thus, an electric voltage tapped along the potentiometer 156 will provide a measure for the position of the center of grinding head 10 along the X- coordinate. The voltage is tapped by a contact 159 carried by bridge 1. A contact 160 is carried by the sled and serves to tap an electric voltage along potentiometer 158. This second electric voltage will provide a measure for the position of the center of the grinding head 10 along the Y- coordinate. In this manner, the path coordinates of the center of the grinding head may easily be determined.

The electronic circuit to be described will determine the path coordinates of the scanning roller which leads the grinding head. The path coordinates may be determined on the basis of certain mathematical relationships and through operation of potentiometer 155.

The length of arm 14, that is, the length of the arm between the center of the grinding head 10 and the axis of rotation of the scanning roller 15 is designated $A_1$. The path coordinates of the grinding head are designated $X_s$, $Y_s$. The path coordinates of the axis of the scanning roller are designated $X_t$, $Y_t$. And, the angle that arm 14 makes in relation to the X- axis is the angle $\alpha$. Thus, the coordinates $X_t$, $Y_t$ of the momentary position of the scanning roller may be expressed, as follows:

$$X_t = X_s - X_t$$
$$= X_s - A_1 \cdot \cos \alpha$$
$$\text{and } Y_t = Y_s - Y_t$$
$$= Y_s - A_1 \cdot \sin \alpha$$

The values corresponding to sine and cosine of the angle $\alpha$ are tapped at the potentiometer 155. Thus, the path coordinates of the scanning roller may be directly calculated by use of the above relationships and the values of voltage corresponding to the path coordinates $X_s$ and $Y_s$ as tapped by the contacts 159, 160 along potentiometers 156, 158, respectively.

This analog system of potentiometers 155, 156 and 158 may be replaced by a corresponding digital system. To this end, so-called "digital scales" may be used in place of the potentiometers 156, 158, and a digital angle function producer may be used in place of the potentiometer 155.

The electronic system for processing the values of voltage from potentiometers 155, 156 and 158 may be seen in FIG. 12. A voltage at the sine tap 162 for the X-axis and the voltage tapped by contact 159 along the potentiometer 156 are combined by a galvanic separating member 163. The summation voltage provides an input to servoamplifier 165. The output of the galvanic separating member and the input to the servoamplifier are connected along line 164. The summation voltage is a theoretical value voltage.

A measuring combination including a motor 166 is driven by the servoamplifier. The measuring combination also includes a tachomachine 167 responsive to the drive of the motor, an impulse generator 168 and a rotary potentiometer 169. The tachomachine responds to the drive of motor 166 and supplies an actual value voltage. The actual value voltage is connected along line 171 to the servoamplifier. The rotary potentiometer supplies the so-called "path reply" and this voltage is connected by line 170 to the servoamplifier. The motor 166 is controlled, therefore, with an output of the servoamplifier representing a difference voltage, that is, a voltage representing the difference between the output of the galvanic separating member 163 and the voltage on line 170.

Under these conditions we are dealing with a follower control. In the case of exact following, the voltage difference equals zero.

A galvanic separating member 173 functions in the manner described in relation to the function of galvanic separating member 163. To this end, a voltage at the cosine tap 172 for the Y- axis and the voltage tapped by contact 160 along potentiometer 158 are combined by the galvanic separating member. The summation voltage provides an input to servoamplifier 175. The output of the galvanic separating member and the input of the servoamplifier are connected along line 174. The summation voltage is a theoretical value voltage.

A measuring combination including a motor 176 is driven by the servoamplifier. The measuring combination also includes a tachomachine 177 responsive to the drive of the motor, an impulse generator 178 and a rotary potentiometer 179. The tachomachine responds to the drive of motor 176 and supplies an actual value voltage connected to the servoamplifier along line 181. The rotary potentiometer supplies a so-called "path reply" and the voltage is connected by line 180 to the servoamplifier. The motor 176 is controlled, therefore, with an output of the servoamplifier representing a difference voltage, that is, as previously discussed, a voltage representing the difference between the output of the galvanic separating member 173 and the voltage on line 181.

Under these conditions, also, we are dealing with a follower control. In the case of exact following, the voltage difference equals zero.

The impulse generators 168, 178 which are mechanically coupled to motors 166, 176 correspond to the digital producers 134, 135 (see FIG. 10) to provide a path signal for further processing. The processing of the path signals may follow the manner of processing described in relation to FIG. 10. The impulse generators 168, 178 deliver path signals for the X- axis and Y- axis, respectively.

As illustrated in FIG. 12, the galvanic separating members 163, 173 are connected to a common tap of potentiometer 155 and a source of power.

In the case of all forms of the invention, the grinding pressure may be regulated to a certain value in the manner and by the system of FIG. 6. In addition, the grinding pressure may be increased or decreased at critical places of movement of the sled around the glass pane. This enhanced capability of regulation of grinding pressure may be provided by torque motor 110, in accordance with a further development of the invention. The signals which are used are the signals delivered by tachomachine 32 which state a measure for the angle-like change of the grinding direction.

Figure 13:
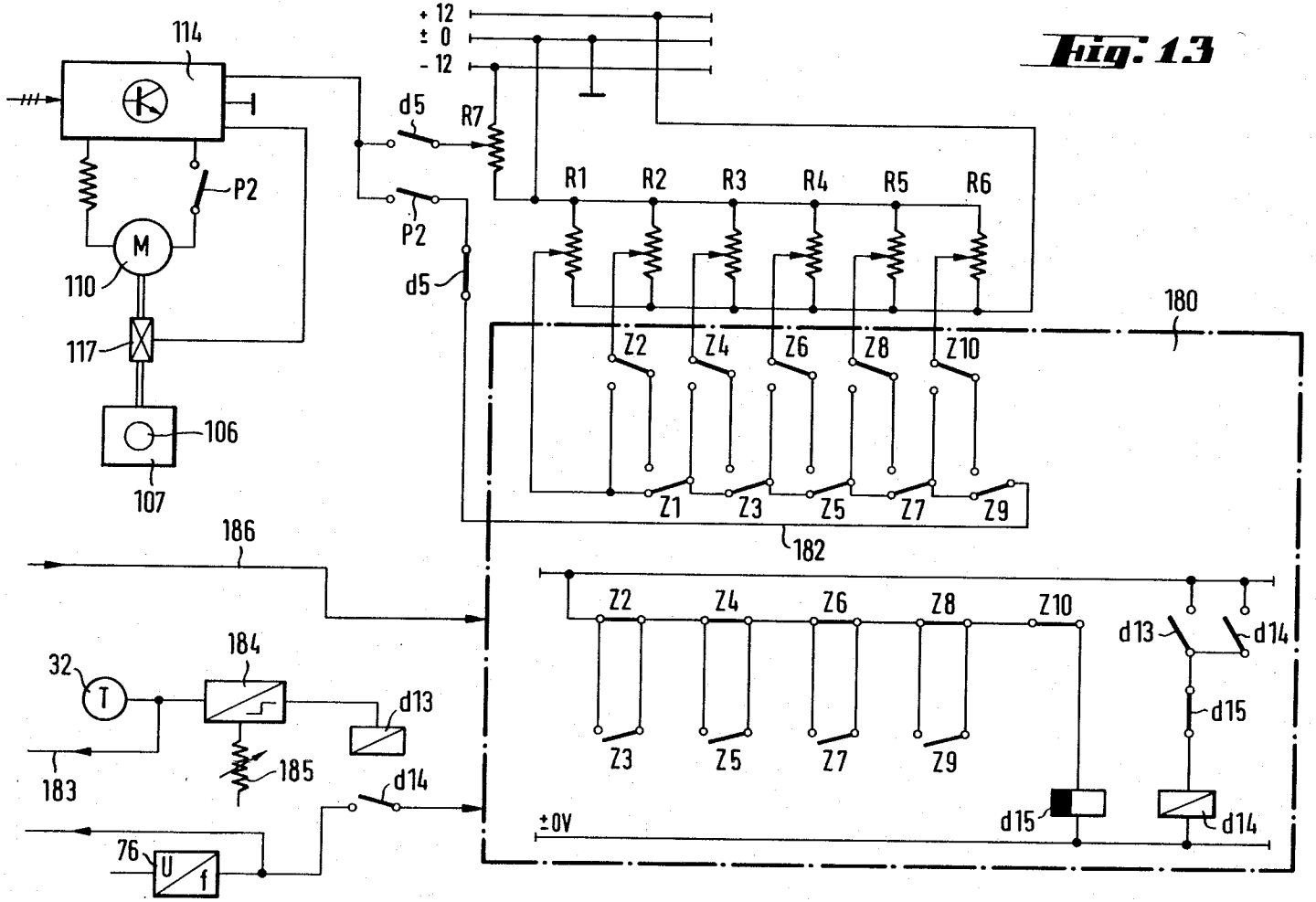
FIG. 13 is a schematic circuit diagram for all forms of the invention for a preprogrammable regulation of the grinding head as it travels around the corners of the glass pane.

A control circuit will provide an "all-around programming" for the grinding pressure whereby the grinding pressure is changed at the corners. The control circuit is illustrated in FIG. 13. The arrangement of the sled 107, grinding head 106, torque motor 110, power load cell 117 and regulator 114 is as discussed in relation to FIG. 6.

The all-around programming is particularly advantageous in the grinding of the edge of a multicorner glass pane. A preselection digital counter 180 may be of the preselection-digital type, illustrated as enclosed within the dash line. Any commercial counter having ten capabilities of preselection may be used. The counter will have a function capability to change, either increase or decrease the grinding pressure at a maximum of five corners and, then, to set the standard pressure once the corner has rotated relative to the grinding tool. The change in grinding pressure will be that of a decrease at a corner and an increase to that of the standard pressure.

Potentiometer R1 functions to adjust a preselected theoretical value of pressure, while the value of guiding pressure, through some decrease for individual corners, is adjusted by adjustment of potentiometers R2–R6. The potentiometers R1–R6 are connected across a positive 12 volt supply voltage. According to operation to be described, the potentiometer R2 may be adjusted to adjust the grinding pressure at a first corner, while the successive potentiometers adjust the grinding pressure at the next and following corners.

A control voltage may be sensed on line 182 and connected through contact P2 to the regulating amplifier 114. The control voltage for the regulator effectively develops the regulator as a 4-quadrant servoamplifier. Potentiometer R7, serves the purpose of raising the grinding pressure at the completion of the grinding process and to pull back the grinding tool to the position at which the grinding process may commence. The supply voltage, adjusted by adjustment of potentiometer R7, is connected through relay switch d5 to the regulating amplifier, also.

A tachomachine 32 provides a control signal for changing, that is, decreasing the grinding pressure at each of the several corners of the glass pane. The tachomachine, also, provides for the expansion of the sliding register along line 183.

The signals delivered by the tachomachine 32 correspond to the angular speed of the arm 14 on which the scanning roller 15 is seated.

The grinding pressure normally will require change when sensing an acute angled corner as the corner moves relative to the grinding tool. The signal from tachomachine 32 is connected to a measuring trigger 184. A potentiometer 185 may be adjusted to control or fix the desired switching point, representing the first corner having the acute character requiring a change of the grinding pressure. Thereafter, tachomachine 32 will signal a corner. Measuring trigger 184 will respond to the corner signal and the relay d13 will energize to close the relay switch d13 and a ganged relay switch d14 thereby to energize d14. Relay d14 is a holding relay and connects the counter 180, then at a zero level, with the timing pulse generator 76. It will be recalled that the timing pulse generator is mechanically coupled to drive shaft 57. As illustrated in FIG. 4, the timing pulse generator is connected to the sliding register to provide timing in accordance with the speed of rotation of the drive shaft.

The counter 180 is programmed in a manner that after a turn of the roller 15 through the angle $\alpha$, meter relay Z1 will respond. Whereas, heretofore, potentiometer R1 functioned to adjust the standard pressure or preset the theoretical value, a response of meter relay Z1 will switch potentiometer R2 into the circuit and switch potentiometer R1 out of the circuit. Thus, potentiometer R2 will be used to preset the theoretical value. The potentiometer R2 will remain on as a result of that preselection and will remain for a period determined by the rotary angle of roller 15. When meter relay Z2 shall be triggered, the potentiometer R1, again, will be connected to the control voltage and the circuit to potentiometer R2 will open. At the instant of triggering the meter relay Z2 the circuit to circuit breaker wiper D15 will open. As a result of the open circuit, relay switch D15 opens to deenergize relay d14. The counter timing, then, is interrupted and the counter 180 is stopped. This condition remains until the speedometer machine 32 responds to the second corner having the acute angle character which shall require a change in the grinding pressure.

When there shall be a response from tachomachine 32, the relay d13 is energized to again energize relay d14 and the process which has been described is repeated. The process is repeated, however, through operation of meter or preselection relays Z3 and Z4. These preselection relays and their operation result in the simultaneous switching of potentiometers R1 and R3 into and out of the control voltage circuit. In this manner one potentiometer or the other will be operative in a control sense. When potentiometer R3 is switched out of the circuit the circuit to relay d15 opens. The process is repeated through response of speedometer machine 13 to the remaining corners having the critical acute character. In these responses the preselection relays Z5 and Z6, . . . Z9 and Z10, if there shall be five corners, will operate.

A glass pane having a number of corners, up to five corners with each corner having an acute characteristic requiring a change in grinding pressure, may be ground following the described process. And, each corner may be ground to by application of a different grinding pressure by adjustment of the potentiometers R2–R6. At the completion of the all-around grinding process, an eraser entry over line 186 sets the counter 180 to zero.

We claim:

1. A process for the automatic all-around path control of a processing tool for glass panes disposed on a cross sled capable of movement within an X-Y coordinate system comprising providing a scanning instrument including a scanning organ for scanning a path along said glass pane and an arm mounting said scanning organ, said arm mounted to said processing tool whereby said scanning organ precedes said processing tool in movement by a distance equal to the length of said arm, creating continuously a path control program in response to movement of said scanning organ for control of movement of said processing tool along said path, said path control program being representative during substantially the entire all-around traverse of said glass pane along said path of the spatial position of the scanning organ within the X-Y coordinate system and the angular position of said arm in relation to one of said axes, passing said path control program to a double axis storage, and using said path control program as it passes through said storage for an X-Y coordinate drive for movement of said processing tool along each stretch of movement in front of said processing tool which is substantially equal to the length of said arm connecting said processing tool and said scanning organ.

2. An apparatus for the automatic all-around path control of a processing tool mounted on a cross sled adapted for movement within an X-Y coordinate system comprising an X- drive motor and a Y- drive motor for driving said cross sled, a scanning instrument including a scanning organ for scanning a path along an edge of a glass pane and an arm mounting said scanning organ, said arm mounted to said cross sled for rotation about the axis of said processing tool, said arm locating said scanning organ in advance of said processing tool and maintaining said scanning organ and processing tool at a spaced distance equal to the length of said arm, means for maintaining said scanning organ in position against said glass pane, means responsive to the spatial position of said scanning organ within the X-Y coordinate system and the angular position of said arm in relation to one of said axes, said means generating continuously a signal representative of said positions for said path control, a storage having a double axis storage and a capability of storing said signal for path control over a distance of movement always equal to the length of said arm, said signal being connected to said storage and passed to an output, and circuit control means connected at said storage output for regulating the speed ratio of said X-Y drive motors.

3. The apparatus of claim 2 wherein said processing tool is a grinding wheel, and wherein said scanning organ is a scanning roller, said scanning roller having a diameter corresponding to the diameter of said grinding wheel.

4. The apparatus of claim 2 wherein said means for maintaining contact between said scanning organ and said glass pane is a torque motor, said torque motor acting on said arm through said rotational axis.

5. The apparatus of claim 2 including an angular rotation measuring instrument, a shaft supported within said measuring instrument and adapted for rotation about its axis, said shaft extending through said measuring instrument to a distal end, a sliding gear, an arm for mounting said gear on said distal end of said shaft whereby said gear is adapted to roll along a fixed surface to rotate said shaft, and means coupling said measuring instrument to said scanning organ so that said measuring instrument follows the movement of said scanning organ.

6. The apparatus of claim 5 wherein said means coupling said measuring instrument and scanning organ maintains said measuring instrument in a fixed spatial angular disposition.

7. The apparatus of claim 6 wherein said coupling means includes said gear mounted on said shaft, a fixed sun gear, and a chain kinematically coupling said rotatable gear and sun gear, and wherein the angular position of said shaft gear is determined by the angularly fixed sun gear.

8. The apparatus of claim 5 wherein said measuring instrument is an inductive rotation generator.

9. The apparatus of claim 5 wherein said coupling means includes a second arm, an element connecting said arms for conjoint movement in spatial position within the coordinate system and in angular position whereby said shaft remains coaxial with an axis of said scanning organ, and wherein said coupling means connects said arms kinematically.

10. The apparatus of claim 5 wherein said measuring instrument is a sine-cosine potentiometer.

11. The apparatus of claim 2 wherein said storage is an extendable sliding register with a variable number of storage locations, said number of storage locations being controlled by the speed of movement of said arm from one angular position to another.

12. The apparatus of claim 11 including a tachomachine, said tachomachine being mechanically coupled to said arm and responsive to said speed of movement, and said tachomachine providing a starting voltage representative of said speed of movement, said starting voltage providing said control in said number of storage positions.

13. The apparatus of claim 9 wherein said element of said coupling means is a coupling shaft, each arm being rigidly connected to said coupling shaft, and further comprising a tachomachine, said tachomachine being mechanically coupled to said coupling shaft and responsive to the speed of movement of said arm from one angular position to another.

14. The apparatus of claim 13 wherein said storage is an extendable sliding register with a variable number of storage locations, said number of storage locations being controlled by a response of said tachomachine.

15. The apparatus of claim 2 wherein said storage comprises a part of a microcomputer.

16. The apparatus of claim 2 including a pair of potentiometers, each potentiometer connected to said generating means for determining a maximum voltage output in regulating the speed ratio of said X-Y drive motors.

17. The apparatus of claim 2, characterized in that the processing tool is a grinding head mounted rotatably on said cross sled and wherein the angular position of said grinding head is determined by a driving motor controlled by said signals which regulate the speed ratio of the X- and Y- drive motors.

18. The apparatus of claim 17, characterized in that the signals taken from said storage reproducing the actual values of the X- Y-driving motors and used for the control of the grinding head drive motor, are fed to a double sine-cosine potentiometer whose rotational axis is mechanically coupled with the rotational axis of the grinding head drive motor, and a regulator for said last-mention motor.

19. The apparatus of claim 18, characterized in that the voltages tapped from the double sine-cosine potentiometer are used for the control of a timing generator which determines the timing frequency of the storage.

20. The apparatus of claim 2 further including a sled, said processing tool mounted on said sled, and means acting of said sled for adjustment of pressure exerted by said processing tool against said glass pane.

21. The apparatus of claim 20 including a torque motor, said contact pressure being developed by the torque motor, a pressure load cell having an electric output signal which is fed to a regulator for triggering said torque motor for the control of the predetermined contact force.

22. The apparatus of claim 20, characterized in that said grinding pressure of said processing tool during travel around a corner is adapted to be changed by signals developed by a tachomachine mechanically coupled to and responsive to the angular speed of movement of said arm rotationally.

23. The apparatus of claim 22, including a preselection counter, a plurality of adjusting potentiometers, one said potentiometer for being assigned to the contacts of the preselection counter for the preselection of the pressure desired at the individual corners of the glass pane.

24. The apparatus of claim 2, characterized in that a program switching mechanism is provided for the control of grinding pressure exerted by said processing tool against said glass pane.

25. An apparatus for the automatic all-around path control of a processing tool mounted on a first cross sled adapted for movement within an X-Y coordinate system comprising an X-drive motor and a Y-drive motor for driving said cross sled, a scanning instrument including a scanning organ for scanning a path along an edge of a glass pane and an arm mounting said scanning organ, said arm mounted to said sled for rotation about the axis of said processing tool, said arm locating said scanning organ in advance of said processing tool and maintaining said scanning organ and processing tool at a spaced distance equal to the length of said arm, means for maintaining said scanning organ in position against said glass pane, means responsive to the spatial position of said scanning organ within the X-Y coordinate system and the angular position of said arm in relation to one of said axes, said means responsive to said spatial position comprising a second cross sled also movable within an X-Y coordinate system located in spaced parallel relation to said first-mentioned system within which said first cross sled moves, and a pair of digital generator apparatus, each digital generator apparatus mechanically coupled to said second cross sled adapted to generate continuously a signal representative of said spatial position, a storage having a double axis storage and a capability of storing said signal for path control over a distance of equal to the length of said arm, said signal being connected to said storage and passed to an output, and circuit control means connected at said storage output for regulating the speed ratio of said X-Y drive motors.

26. An apparatus for the automatic all-around path control of a processing tool mounted on a cross sled adapted for movement within an X-Y coordinate system comprising an X-drive motor for driving said cross sled, a scanning instrument including a scanning organ for scanning a path along an edge of a glass pane and an arm mounting said scanning organ, said arm mounted to said sled for rotation about the axis of said processing tool, said arm locating said scanning organ in advance of said processing tool and maintaining said scanning organ and processing tool at a spaced distance equal to the length of said arm, means for maintaining said scanning organ in position against said glass pane, means responsive to the spatial position of said scanning organ within the X-Y coordinate system and the angular position of said arm in relation to one of said axes, said means responsive to said spatial position comprising a first and second potentiometer, one of said potentiometers being located along and parallel to said X-axis, while the other potentiometer is located along and parallel to said Y-axis, a first and second tap, each tap carried by said cross sled to tap an electric voltage representative of the spatial position, a rotation measuring instrument with sine-cosine response characteristics coupled mechanically to said arm for signal response representative of the angular position, a storage having a double axis storage and a capability of storing said signals for path control over a distance of a length equal to the length of said arm, said signal being connected to said storage and passed to an output, and circuit control means connected at said storage output for regulating the speed ratio of said X-Y drive motors.

* * * * *